United States Patent [19]

Dobby et al.

[11] 3,977,145

[45] Aug. 31, 1976

[54] HORIZONTAL SIDING PANEL JOINT SUPPORT

[75] Inventors: Gerald B. Dobby; David Henderson, Canada

[73] Assignee: Hunter Douglas International N.V., Curacao, Netherlands Antilles

[22] Filed: Mar. 26, 1975

[21] Appl. No.: 562,119

[52] U.S. Cl. ..... 52/531; 52/470; 52/521; 52/553

[51] Int. Cl.[2] ..... E04D 3/362; E04D 3/366

[58] Field of Search ..... 52/470, 472, 521, 530, 52/531, 553, 478, 520, 547

[56] References Cited

UNITED STATES PATENTS

| | | | |
|---|---|---|---|
| 1,978,519 | 10/1934 | Willock et al. | 52/553 X |
| 2,361,450 | 10/1944 | Black | 52/553 X |
| 3,339,333 | 9/1967 | Kovalcik | 52/531 X |
| 3,380,214 | 4/1968 | Stevens | 52/530 X |

*Primary Examiner*—Alfred C. Perham
*Attorney, Agent, or Firm*—Pennie & Edmonds

[57] ABSTRACT

A joint support is adapted to be disposed beneath a joint at adjacent ends of horizontally disposed overlapping siding panels to support same and to assist in preventing the formation of a gap at said joint by virtue of inward buckling or deflection of one of the panels relative to the other. The joint support, as seen in a cross-section view taken at right angles to the longitudinal dimension of the panels in the installed condition has a wedge taper and has minimum thickness adjacent a first end which, in use, is uppermost. The opposite end of the joint support is contoured or shaped to overlie and accommodate the panel holding lip of a preceding lower panel. The first end of the joint support has an outwardly and downwardly turned portion adapted to fit over the panel holding lip or lips of the panels which the joint support, in use, underlies and the opposite end of the joint support includes shallow hook means thereon for snap fitting engagement over the holding lip of the preceding lower panel.

4 Claims, 5 Drawing Figures

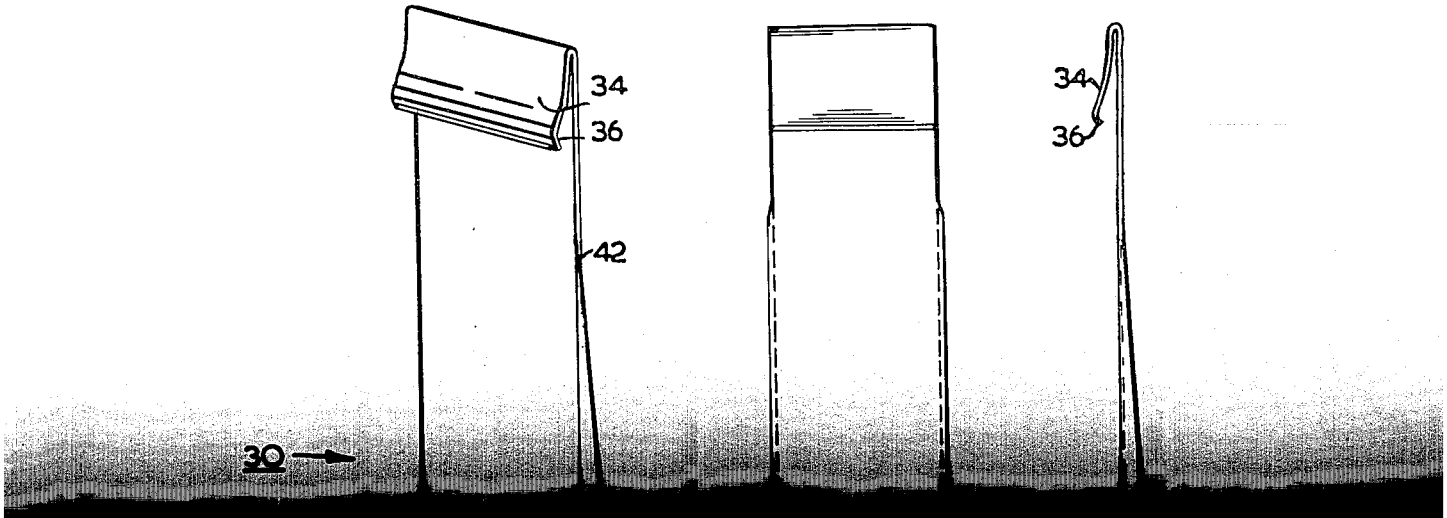
34
36
42
30
34
36

HORIZONTAL SIDING PANEL JOINT SUPPORT

This invention relates to a support adapted to be disposed beneath the joint at adjacent ends of horizontally disposed overlapping siding panels to support such panels in the region of the joint.

During the application of siding panels, especially thin aluminum siding panels, one of the most difficult problems relates to the provision of a completely flat overlap at the joints between adjacent ends of the panels. This problem exists in "in plant" cut panels as well as "field cut" panels and also in panels that are backed with an insulating material as well as unbacked or hollow panels. In many cases there is a tendency for one of the panels to buckle or deflect inwardly thus leaving an unsightly gap at the region of the overlapping joint through which wind and rain may enter. The problem is often caused by incorrect installation including errors in nailing techniques. Furthermore, the surfaces to which the siding is being applied may not be very even; this is particularly the case when new siding is being installed on "old" construction. The problem may be alleviated somewhat by "crowning" the edges at the ends of the panels slightly to thereby stiffen them so that they resist inward deflection and the formation of the unsightly gap referred to above; however, this procedure requires some skill and patience on the part of the installers so if unskilled labour is employed and/or the installers must work at excessive rates of speed, the crowning procedure is either carried out poorly or not at all.

It is accordingly an object of the invention to provide a joint support adapted to be disposed beneath the joint or overlap between adjacent ends of the siding panels to resist the inward buckling and the formation of the unsightly gap referred to above.

It is a further object of the invention to provide a generally rigid support for the ends of the panels at the overlap, which support can be used directly over a stud or furring strip or between studs and which support can be used with backed or unbacked siding, which support is simple, easy to fabricate and hence very economical to provide.

A further object is to provide a joint support which can be put in place by moving same vertically down and "snap fitting" it behind an already completed joint at the overlap or inserted laterally behind one panel before the next panel is placed in position.

According to the invention, in one aspect there is provided a joint support adapted to be disposed beneath a joint at adjacent ends of horizontally disposed overlapping siding panels to support same and to assist in preventing the formation of a gap at said joint by virtue of inward buckling or deflection of one of the panels relative to the other, said joint support, as seen in a cross-section view taken at right angles to the longitudinal dimension of the panels in the installed condition having a wedge taper and having minimum thickness adjacent a first end which, in use, is uppermost, the opposite end of the joint support being contoured or shaped to overlie and accommodate the panel holding lip of a preceding lower panel, said first end of the joint support having an outwardly and downwardly turned portion adapted to fit over the panel holding lip or lips of the panels which the joint support, in use, underlies.

In a further aspect of the invention said opposite end of the joint support includes shallow hook means thereon for snap fitting engagement over the holding lip of the preceding lower panel.

In a still further aspect of the invention the joint support comprises a single piece of sheet metal having a major frontal surface adapted to contact and directly underlie the panels which it supports, and a pair of flanges extending along the margins of said surface and at right angles thereto from adjacent said first end to said opposite end, said flanges each being uniformly tapered to provide said wedge taper for the joint support.

Other aspects of the invention will be apparent from a review of the claims appended hereto.

In the drawings of an illustrative example of an embodiment of the invention:

FIG. 3 is a perspective view of the joint support per se according to the invention;

FIGS. 4 and 5 are front and side elevation views, respectively, of the joint support.

Figure 1:
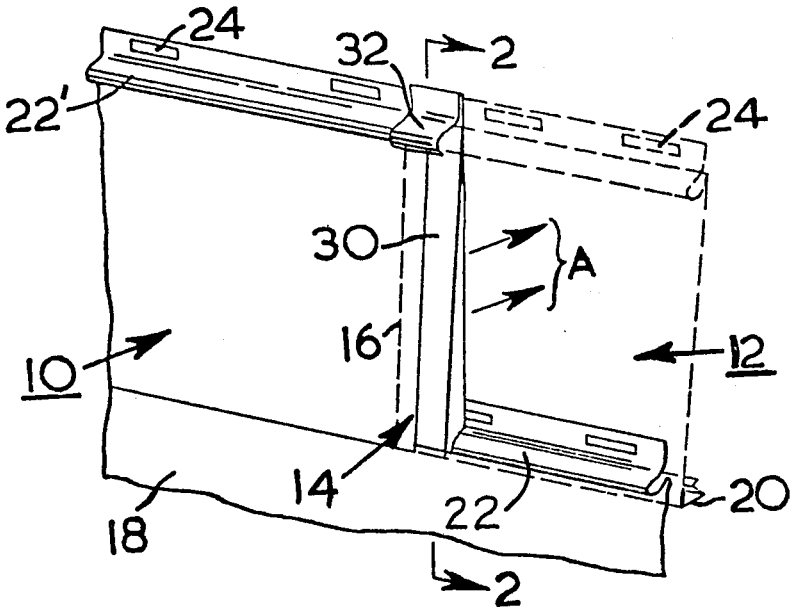
FIG. 1 illustrates a joint between adjacent siding panels (one of which is shown in phantom) such joint being provided with a joint support in accordance with the invention.

With reference to the drawings FIG. 1 shows adjacent siding panels 10, 12 (panel 12 being shown in phantom) and a joint 14 defined between the overlapping ends of same. The end of panel 10 actually overlaps panel 12 for a short distance and the end of panel 12 is shown by dotted line 16. Numeral 18 shows a portion of a preceding lower panel extending below and across joint 14 in known fashion.

The siding panels are of known construction, usually of sheet aluminum and they may or may not include an insulating backing. The lower edge of each panel is provided with an upwardly and inwardly directed locking flange 20 which is adapted to engage in snap fit relation in a channel defined by a locking lip 22 defined along and a short distance below the upper edge of the next adjacent lower siding panel. Locking lip 22 is defined by an outwardly and downwardly extending elongated loop or bight of the metal panel with said channel defined between such loop or bight and that portion of the panel face which it overlies.

The siding panels are provided with a series of spaced elongated slots 24 along the upper edge thereof. These slots 24 are for the purpose of permitting nails to be inserted therein and driven into the siding support e.g. a wall, stud, or furring strip depending on the nature of the construction. Slots 24 permit a certain degree of longitudinal movement of the siding panels to take place under the influence of thermal expansion forces.

As explained previously, the main object is to prevent an unsightly gap forming by virtue of one of the panels, e.g. panel 12 in FIG. 1 buckling or deflecting inwardly in the direction of arrows "A" to allow a gap to form between the overlapping portions of panels 10 and 12. The reasons for the formation of such gap are explained earlier in this specification and need not be repeated here.

In order to eliminate such gap, a joint support 30, as illustrated in FIG. 1, is provided. It will be seen from FIGS. 1 and 2 that the joint support 30 is disposed beneath the joint 14 between the adjacent overlapping ends of the siding panels 10 and 12. The joint support prevents inward buckling or deflection of one of the panels relative to the other.

Figure 2:
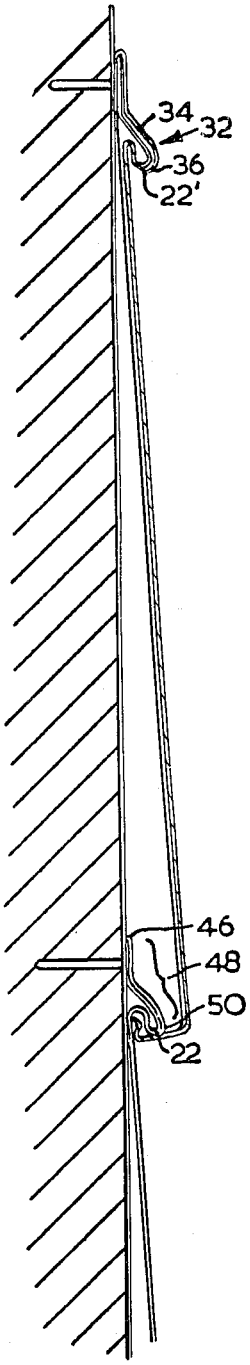
FIG. 2 is a section view of the siding joint and the joint support taken along line 2—2 and looking in the direction of the arrows.

The joint support, as seen in the side elevation section-view of FIG. 2 which is taken at right angles to the longitudinal dimension of the installed panels, has a wedge-like taper and has a minimum thickness adjacent that end which, in use, is disposed uppermost and a maximum thickness adjacent its lower end. It will also be seen, particularly from FIG. 2, that the lower end of the joint support is contoured or shaped to overlie and accommodate the panel holding lip 22 of the preceding lower panel. It will also be seen from the drawings, e.g. FIG. 2, that the upper end of the joint support includes an outwardly and downwardly turned portion 32 adapted to fit over the panel holding lip 22' of the panel or panels which the joint support 30, in use, underlies. It will be seen from the drawings that this downwardly turned portion 32 includes a downwardly and outwardly extending portion 34 and an inwardly extending terminal portion 36 which is adapted to hook under the panel holding lip 22' and to resist upward motion of the joint support 30 relative to the panels 10 and 12.

As best seen from FIGS. 3–5, the joint support 30 comprises a single piece of sheet metal, preferably aluminum, having a major frontal surface 38 adapted to contact and to directly underlie the joint 14 formed between the panels which it supports, with a pair of flanges 40 extending along the margins of said surface 38 and being substantially at right angles to surface 38. It will be seen that the flanges 40 extend from a point 42 which is spaced downwardly somewhat from the upper end of the joint support to the opposite or lower end 44 of the joint support. The two flanges 40 are each uniformly tapered and increase in width from point 42 towards the lower end of the joint support whereby to provide the wedge-like taper referred to above.

With particular reference to the lower end 44 of the joint support 30, it will be seen that there is provided a step 46 whereby to accommodate the upper marginal edge portion of the preceding lower panel, as best illustrated in FIG. 2, with the portion indicated by the brackets 48 being contoured so as to closely follow the contour of the panel holding lip 22 as previously described. The exact contour here is not critical so long as a proper fit is obtained. However, it is most important to note that the lower ends of flanges 40 are each provided with shallow hooks 50 which are arranged for snap-fitting engagement over the holding lip of the preceding lower panel. The shallow hooks 50 in the flanges 40, in combination with the inwardly extending terminal end portion 36 on portion 32 adjacent the upper end of the joint support, together tend to properly locate the joint support in position and to resist upward movement of the joint support relative to the panels. The hooks 50 and the inwardly turned terminal end portion 36 are of limited extent only (i.e. they define relatively shallow depressions or hooks) in order to provide for ease of installation. Once the joint support has been installed and the panels correctly nailed in position, there is little likelihood of the joint support moving out of position.

The manner of installation of the joint support will be readily apparent to those skilled in the art. On new construction, the panels and the joint supports can directly overlie the wall panels whether they be plywood or, alternatively, an insulating board type of material such as "Tentest" or like material. On other types of construction it may be necessary to provide vertically disposed, horizontally spaced furring strips and in this case, it is usually the practice to form the joints between the various panels at the furring strips.

In the installation of the panels and the joint strip, it will be assumed that panel 12, as shown in FIG. 1, is already in position. Care is taken not to nail panel 12 too close to the joint. Then, the joint support 30 is slid laterally into position (i.e. to the right as seen in FIG. 1) so that it is disposed beneath the end of the panel 12. Because of the fact that the thickness and degree of taper of the joint support 30 have been chosen so as to accommodate the dimensions of the panel 12, the joint support provides firm support for the end of the panel and prevents any inward deflection or buckling of same. Then, the next panel 10 is fitted into position so that its end portion overlaps the previously mentioned end portion of panel 12. The previously mentioned downwardly extending portion 32 adjacent the upper end of the joint support 30 extends over the panel holding lips 22 of the panels 10 and 12 in the installed position. The panels 10 and 12 are then nailed in position. No nails are driven directly through the upper end of the joint support 30 but, rather, the practice is to nail on both sides of the joint support in the slots provided in the respective panels as previously described.

As an alternative to the above described method of installation, the panels 10 and 12 may be installed in a conventional manner; however, their adjacent overlapping ends are not nailed to the support structure but rather are left free so that they can be deflected outwardly a short distance whereby to permit the joint support to be slipped behind the panels at the joint therebetween and then pushed downwardly so as to cause the above-mentioned hooks 50 at the lower end of the joint support to snap over the holding lip 22 of the preceding lower panel and at the same time cause the inwardly bent terminal portion 36 to snap over and engage the holding lip of the panels beneath which the joint support 30 is installed.

The embodiments of the invention in which an exclusive property or privilege is claimed are defined as follows:

1. A joint support for supporting the overlapped ends of elongated horizontally disposed siding panels to prevent the formation of a gap at said joint, said joint support comprising an elongated piece of shaped sheet metal arranged to be disposed behind said joint with its longitudinal extent substantially vertical, said joint support including a major frontal surface and along each of its lateral edges a rearwardly extending flange, each of said flanges extending downwardly from a point near to but spaced from the upper end of said joint support to the lower end of said joint support, each of said flanges being substantially wedge-shaped with the thin part of said wedge-shape being adjacent the upper end of said flanges, the rearward extent of said flanges at the lower end thereof being cut away to a shape which is complementary to the upper longitudinal edge of the siding panels, the upper end of said joint support having a generally outwardly and downwardly extending portion having a shape complementary to the shape of the upper longitudinal edges of said siding panels, and said upper end of said joint support being spaced from and springable away from the frontal surface of said joint support for engagement over the upper edges of the siding panels at said overlapped joint.

2. The joint support of claim 1 in which the lower extremity of said flanges terminates in a hook for snap fitting engagement over the holding lip of the preceeding lower panel.

3. A siding construction comprising a vertical support structure, a series of elongated horizontally disposed siding panels secured to said structure, each of said panels adjacent its upper edge having an outwardly and downwardly disposed holding lip, each of said panels along its lower edge having an inwardly extending locking flange for engagement beneath a holding lip of the next lower row of panels, the major surface of said panels being disposed along their lower edges at a distance from said vertical support structure that is substantially greater than the distance between said vertical support structure and the upper edges of the major surface of said panels whereby the space between said vertical support structure and the major surface of said panels is wedge-shaped with the thin portion of said wedge-shaped being uppermost, the ends of each of said panels being overlapped with the adjacent edge of the next panel in the same row thus providing an overlapped joint, a joint support for supporting the overlapped ends of elongated horizontally disposed siding panels to prevent the formation of a gap at said joint, said joint support comprising an elongated piece of shaped sheet metal arranged to be disposed behind said joint with its longitudinal extent substantially vertical, said joint support including a major frontal surface and along each of its lateral edges a rearwardly extending flange, each of said flanges extending downwardly from a point near to but spaced from the upper end of said joint support to the lower end of said joint support, each of said flanges being substantially wedge-shaped with the thin part of said wedge-shape being adjacent the upper end of said flanges, the rearward extent of said flanges at the lower end thereof being cut away to a shape which is complementary to the upper longitudinal edge of the siding panels, the upper end of said joint support having a generally outwardly and downwardly extending portion having a shape complementary to the shape of the upper longitudinal edges of said siding panels, said upper end of said joint support being spaced from and springable away from the frontal surface of said joint support for engagement over the upper edges of the siding panels at said overlapped joint, and the frontal surface of said joint support bearing against the innerside of panels at an overlapped joint to support the same against inward deflection.

4. The siding construction of claim 3 in which the lower extremity of said flanges terminates in a hook for snap fitting engagement of the holding lip of the panel in the next lower row of panels.

* * * * *